United States Patent [19]

Balaguer

[11] 4,177,719

[45] Dec. 11, 1979

[54] COOKING PROCESS AND APPARATUS

[76] Inventor: Rodolfo R. Balaguer, 2607 Grace Dr., Harbor Beach, Fort Lauderdale, Fla. 33316

[21] Appl. No.: 635,055

[22] Filed: Nov. 28, 1975

Related U.S. Application Data

[63] Continuation-in-part of Ser. No. 536,105, Dec. 24, 1974, abandoned.

[51] Int. Cl.[2] ..... H05B 7/06

[52] U.S. Cl. ..... 99/358; 219/541

[58] Field of Search ..... 99/358, 331, 339, 340, 99/373, 390, 408, 419, 445; 219/10.51, 432, 522, 541, 545, 548–549; 338/212; 292/256, 257, 258, 305, 308

[56] References Cited

U.S. PATENT DOCUMENTS

| | | | |
|---|---|---|---|
| 853,128 | 5/1907 | Simmons | 294/114 |
| 1,319,610 | 10/1919 | Norling | 292/257 X |
| 1,402,873 | 1/1922 | Ledwinka | 219/300 X |
| 1,581,526 | 4/1926 | Willsea | 294/104 X |
| 1,781,302 | 11/1930 | Roberts | 99/450 |
| 2,012,618 | 8/1935 | Park | 99/331 X |
| 2,606,587 | 8/1952 | Porter | 292/257 X |
| 2,844,695 | 7/1958 | McLean | 99/358 X |
| 2,939,793 | 6/1960 | Richman | 99/358 UX |
| 3,045,861 | 7/1962 | Dieter et al. | 292/257 X |
| 3,210,199 | 10/1965 | Schlaf | 99/358 UX |
| 3,342,977 | 9/1967 | Anderson | 219/548 |
| 3,397,303 | 8/1968 | Smith | 219/545 |
| 3,400,253 | 9/1968 | Marker | 219/541 |
| 3,537,387 | 11/1970 | Sierk et al. | 99/358 |
| 3,715,975 | 2/1973 | King | 99/331 |
| 3,829,654 | 8/1974 | Eisler | 219/386 |
| 3,962,961 | 6/1976 | Peters | 99/450 |

*Primary Examiner*—Harvey C. Hornsby
*Assistant Examiner*—Arthur O. Henderson
*Attorney, Agent, or Firm*—Charles B. Smith; Robert R. Jackson

[57] ABSTRACT

A method and apparatus for cooking a wide variety of foods wherein the food to be cooked is placed in contact with a sheet of conductive material, which has been connected by clamping members to an electrical power source capable of supplying a low voltage, high current. A food may be wrapped in a thin sheet of conductive material, such as a metal foil, and cooked by passing current through the thin sheet or foil. The process is characterized by a high efficiency and short cooking time. Preferred conductive material are disposable, for example aluminum foil, thereby avoiding cleaning after cooking.

The apparatus includes means for supplying a high current, at a low voltage. Electrically connected to the current supply means are a pair of clamps for clamping an electrically conductive sheet. Preferably, the clamps are independently operable and each comprise a curved movable member and a fixed member, together with means for moving the movable member. Also, one of the clamps is preferably movably mounted so that the spacing between the clamps may be varied.

6 Claims, 16 Drawing Figures

34'
34
37
67
40
29
10
30
36

COOKING PROCESS AND APPARATUS

This is a Continuation-in-Part of my copending application, Ser. No. 536,105, filed Dec. 24, 1974 now abandoned.

BACKGROUND OF THE INVENTION

A number of processes have been developed for heating food. For example, it is common knowledge that food can be cooked or otherwise heated in an oven, or a range or over a fire. Although different implements are used in each of these processes, e.g. the food may be placed within a pot or mounted on a spit, almost all of these heating or cooking processes share the common denominator of a high temperature heat source. Thus, in the case of a gas fired oven or range, an open flame is the source of heat and in the case of an electric range, oven or broiler, a high temperature, electrically heated element supplies the required heat. Indeed, in the case of an electrically heated oven the heating element may be incandescent.

The use of a high temperature heat source in conventional cooking processes is necessitated by the heat transfer mechanisms which are relied upon. For example, when foods are broiled there is no physical contact between the heat source and the food. Thus, it is commonly believed that the prevailing heat transfer mechanism is radiation and since radiant heat transfer increases with the fourth power of the absolute temperature of the heat source, high temperature heat sources such as an open flame or an incandescent tube are employed.

Similarly, when foods are fried or otherwise heated in a thick pan or pot, the prevailing heat transfer mechanism within the pot is conduction. Thus, heat must be conducted through the pot or pan and then transferred by conduction from the pan surface to the food. In order for heat to be transferred by conduction, through the pan and then to the food, a high temperature difference must exist between the external heat source and the food. Therefore, resort was made to an open flame or a high temperature, electrically heated element.

Traditional prior art cooking processes, e.g. roasting, broiling and frying, employed a high temperature heat source. The efficiency of such processes is generally very poor, i.e. a substantial quantity of heat must be generated in order to transfer a small portion of such heat to the food or article to be cooked or heated. In the case of radiant heat transfer, such low efficiency arises because a high temperature heat source will radiate heat in all directions. Thus, with an open flame or electrical element heating a pot or broiling a food, heat will be radiated in all directions and only a portion of the radiated heat from the flame or electrical element will be transferred to the pot or food article to be heated. Therefore, a substantial quantity of the heat generated by an open flame or electrical heater will heat the air and thereby be lost.

In the case of frying or heating foods in a pan or pot, other sources of inefficiencies are inherently present. For example, it is obvious that in such processes the heavy pan or pot itself must be heated. Thus, a portion of the cooking heat generated will not be used for cooking but will, instead, be used to heat the heavy container in which the food is located.

The inefficiencies which attend the practice of heating processes wherein a pot or pan is used were recognized by prior art workers and efforts were made to minimize such inefficiencies by expedients such a fabricating thick pots from materials which had a high thermal conductivity, e.g. aluminum. Although these expedients reduced (but did not eliminate) some of the inefficiencies heretofore mentioned, there are still other sources of inefficiency which could not be avoided. For example, anytime a high temperature heat source is employed, the entire surroundings are heated and the heating efficiency of the process is poor.

An inefficiency which attends the practice of broiling and which is essentially unavoidable results from the fact that substantially the same amount of heat is generated in a given size apparatus irrespective of the quantity of food which is cooked. Thus, if one cooks a single hamburger or six hamburgers in a broiler, because of the indiscriminate heat generation substantially the same amount of heat will be generated in either case. As a result, when only one or two small articles are broiled, the efficiency in terms of the amount of heat generated per pound of food cooked is exceedingly low.

In addition, it is known that as a result of broiling or frying there are utensils which must be cleaned. Thus, both the oven and the food container must be cleaned after food is heated or cooked.

In summary, it will be appreciated that the domestic practice of traditional food cooking processes, such as broiling, roasting and heating foods in a pot or pan, are characterized by low efficiencies and undesirable side effects in the nature of overheating the cooking environment and producing utensils which must be cleaned.

In addition to traditional domestic cooking processes, the prior art also discloses a number of other cooking processes.

For example, a recently developed cooking process employs microwaves to heat food. Although microwave cooking overcomes some of the disadvantages of traditional prior art cooking processes, certain other disadvantages are still present. For example, the conversion efficiency from A.C. power to microwaves is only approximately 50%. Additionally, since microwave devices operate by generating heat within the food surface rather than transferring from a high temperature source, the outer surface of a food cooked in a microwave oven may lack the browned appearance which most people have come to associate with certain cooked foods, e.g. steaks or hamburgers. In addition, microwave ovens are particularly expensive and their design and operating characteristics are such that certain safety problems are presented requiring radiation shielding.

Another prior art food heating process is exemplified by the disclosures of U.S. Pat. Nos. 3,361,054, 2,648,275, 2,474,390, 2,059,133, 1,990,412, 1,915,962, 1,902,564, 1,882,363, 1,802,532. In the process disclosed in these patents, an elongated food article, e.g. a frankfurter or potatoe, is mounted on a metal pin which contains a high temperature electrical heater. Thus, it will be seen that this process, like traditional processes, resorts to the use of a high temperature heat source to heat a food which is isolated from the heat source. Therefore, heat must be transferred from the heating element through the metal pin and the pin itself must be heated before heating of the food commences. In addition, any device for practicing such a process has only very limited utility.

Another food heating process suggested by the prior art is disclosed in U.S. Pat. Nos. 267,684, 2,939,793, 2,896,527, 2,226,036, 2,222,087. In accordance with the process disclosed in these patents, a food is heated by passing an electric current directly through the food. In the practice of this process it is often necessary to specially prepare the food article so as to enhance its conductivity or provide a surface which can be appropriately connected to an electrode. In addition to the disadvantage of often requiring specific preparation of the food, the practice of this process, like microwave cooking, apparently did not provide a desired browning of the food, so it was proposed (see U.S. Pat. No. 2,226,036) to include a high temperature radiant heating device to heat and brown the outside of the food. Of course, the utilization of any such radiant heating device would, as noted above, contribute substantially to whatever inefficiencies were already present in the process. Further, more recent prior art workers have noted that if a food is cooked by passing an electric current through the food, the quality of the resulting, heated food may be deleteriously affected as a result of some form of galvanic action. Additionally, it is apparent that the utility of this process, like the previously described process, is limited to a relatively small number of food articles, such as frankfurters. Possibly because of the limited utility of this process and the problems which attend the practice thereof, this process has, to my knowledge, never been widely practiced.

Some prior art workers attempted to bypass completely the traditional cooking processes and provide food articles in a package wherein the package was adapted to generate heat when appropriately connected to a suitable power source. For example, U.S. Pat. No. 3,619,214 discloses a two compartment package having a food in an upper compartment and a lower compartment containing an aqueous conductive solution such as salt water. Disposed in the lower compartment are spaced electrodes. It is asserted in the patent that when the electrodes are connected to a 120 volt power source, current will flow through the saline solution, which will thereby be heated and will boil, whereby the food in the upper compartment will be heated. It is believed evident that the complexity and cost of such a package is such as effectively to foreclose commercial utilization.

U.S. Pat. No. 3,483,358 discloses a food package which includes strip electrodes which are placed upon a film so as to form so-called meander paths. When used, the electrodes are powered by an electric potential on the order of 50 volts. Once again, it would appear that the inherent cost of such a package has precluded any wide spread use.

U.S. Pat. No. 3,751,629 includes a discussion of the difficulty of providing a food package which includes heating electrodes. Thus, it is stated in this patent that "In practice however the conductive pattern usually cannot be allowed to come into direct contact with the substance because such contact may be undesirable for electrical reasons or on account of the nature of the substance and material of the pattern, for reasons of packaging, use or processing or storing of the substance, etc."

As a result of this view, the package disclosed in this patent includes a patterned heating element with an insulating material and a metal foil layer disposed between the heating element and the substance to be heated. The heating element is powered from a 12 volt source. Once again, the complexity and cost of this package would seem to prevent its wide spread use.

U.S. Pat. Nos. 3,210,199 to Schlaf and 3,100,711 to Eisler both disclose a food heating method and food package which may employ a metal foil, e.g. an aluminum foil. Considering first the patent to Schlaf, experiments conducted upon the occasion of my discovery have established the marginal utility of Schlaf's method and carton. More specifically, Schalf proposes an open-ended carton for packaging food articles such as frankfurters wherein the carton walls are constructed of aluminum foil having an insulating material such as cardboard laminated to the outer surface. The carton is formed so as to provide extensions of the carton wall on the same side of the food articles. The extensions are maintained in spaced apart relation by an insulator. When the carton is used to heat the frankfurters contained therein, it is proposed that the extensions are slid into clips wherein one part of each clip bears against the insulated backing and thereby urges the aluminum foil inner surface into contact with an electrical terminal. The electrical terminals may be powered from a source which provides a voltage of one volt. As a result, current will flow through the foil and it is proposed that the interior of the package is thereby heated.

The function of the laminated insulating material is to retain heat within the carton and to provide a resilient backing whereby the carton extensions may be slid into the clips. As previously stated, experiments have established the marginal utility of this package and method. For example, in Schlaf's method and construction both terminals of the power source are connected to the package along a common side thereof. Thus, from an electrical point of view, a number of problems are present. First, if any two parts of the foil should come into contact, the foil at the point or points of contact will melt. Therefore, it is absolutely critical to the practice of Schlaf's process that a spacing insulator be correctly positioned so as to separate the foil extensions of the package and, additionally, the carton must be handled with great care to insure that the walls thereof never come into physical contact. As a corollary of these constraints, it is clear that Schlaf's carton must be open ended.

Still another functional defect which arises from Schlaf's construction of connecting one side of the carton to the power source is the problem of physical support. Thus, unless some unknown means is used to rigidify the carton, the carton must be supported during the heating process lest the weight of the food articles deform the carton thereby permitting opposed walls of the carton to contact each other.

A deficiency intrinsic to Schlaf's process is the apparent reliance on convective heat transfer, i.e. Schlaf states that the heated aluminum foil will heat the interior of the carton. Therefore, it appears that Schlaf is relying upon radiation and convection to transfer heat from the foil to the food. With respect to radiant heat transfer, it was previously pointed out that radiant heat transfer varies with the fourth power of the absolute temperature of the radiating source. Therefore, unless Schlaf's method is practiced in such a manner as to insure that the foil is at a high absolute temperature, relatively little radiant heat transfer will occur. And, militating against the use of high foil temperatures is the combustibility of the insulating laminate which, according to Schlaf, may be cardboard.

Considering convective heat transfer, it will be recalled that the nature of Schlaf's process and carton is such that the aluminum foil carton must, of necessity, be open to avoid a short circuit. Since the foil carton must be open ended, air may then circulate through the carton.

Finally, it should be noted that Schlaf's process and carton construction require the use of an insulated foil material. As such, the process and carton construction disclosed by Schlaf require a specialized construction material which must meet a variety of conflicting requirements. Possibly for this reason and in view of the inefficiencies, complexities and functional problems heretofore noted, Schlaf's process and carton construction has not been used to any known extent.

Eisler, in U.S. Pat. No. 3,100,711, discloses a food package which is similar to the carton proposed by Schlaf, i.e. Eisler proposes to position a series connected metal foil within a package containing food and power the foil with a potential of 12 to 18 volts. Eisler suggests that the foil may be patterned to achieve an appropriate resistance and may be mounted on a plastic foil. In view of the detailed consideration heretofore presented with respect to Schlaf's method and carton and the similarities between Schlaf's and Eisler's method, it is believed sufficient simply to note these similarities and the corresponding deficiencies and functional problems shared by both processes and constructions.

Another prior art cooking process is disclosed by U.S. Pat. Nos. Hager (3,596,059), Park (2,070,491) and Clark (2,140,348). As disclosed in these patents, a pot or other form of food container is directly heated, e.g. by bombarding the pot with an electron beam or passing an electric current through the bottom of the pot. Although such approaches may overcome some of the inefficiencies of traditional prior art cooking processes, other inefficiencies and disadvantages are still present. For example, since a pot is used a certain amount of heat is expended in simply heating the pot rather than the food contained therein. Also, after the pot is heated it will then function to dissipate heat. Further, after the heating or cooking is complete, there remains the problem of cleaning the pot.

U.S. Pat. Nos. 3,771,433 and 3,669,003 to King disclose an apparatus for heating pre-cooked and pre-packaged foods. Among other things, this apparatus appears to have only limited utility and, to the best of my knowledge has never achieved any degree of commercial acceptance.

In summary, the prior art relating to my discovery includes traditional, domestic food heating and cooking processes, the practice of which is characterized by a number of inefficiencies and esthetic drawbacks. In addition to traditional cooking processes, the prior art discloses a number of arcane heating or cooking processes, none of which appear to have achieved any significant degree of commercial acceptance and all of which have limited or marginal utility.

SUMMARY OF THE INVENTION

My invention comprehends a cooking process and apparatus which overcomes or eliminates the inefficiencies or disadvantages associated with prior art cooking processes. In accordance with my process, an article is cooked by placing the surface of the article in contact with a thin sheet of conductive material. In accordance with one embodiment of my invention, a food is placed in contact with a flat sheet of conductive material which is clamped on opposite sides of the food. An electric current is then passed through the sheet in an amount sufficient to cook the food. To pass the current, a low voltage is used. Typically, the voltage will be in the range of, approximately, 0.25 to 2 volts per foot between the clamps. A food may also be wrapped in a thin sheet of conductive material, e.g. a metal foil, and cooked by passing a current through the sheet after opposite ends of the sheets have been clamped.

My process can be practiced using a novel apparatus which is comprised of two pairs of spaced apart clamps which permit a sheet of conductive material to be clamped so that the sheet is horizontally disposed and a food article may be placed in contact with the sheet. The clamps are connected to a low voltage, high current source and preferably clamp the sheet so as to transfer current to both sides of the sheet at each end of the sheet. Each clamp is capable of clamping a sheet having a thickness in the range of, approximately, 0.0005 to 0.125 inches and, over that entire range of thickness, transferring to the sheet a high current without excessive heating at the points where the sheet is clamped.

DESCRIPTION OF PREFERRED EMBODIMENTS

Figure 1:
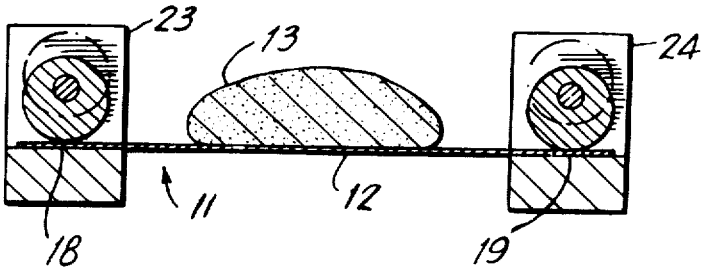
FIG. 1 is a cross sectional view of an embodiment of my invention.

As shown in FIG. 1, in accordance with one embodiment of my process, a food article, such as a hamburger 13, is disposed upon a thin sheet of conductive material 12, e.g. a sheet of household aluminum foil. Such aluminum foil sheets generally have a thickness of approximately 0.001 inches.

Considering aluminum foil as an example, as shown in FIG. 1 the foil 12 is clamped on opposite sides of the hamburger 13 such that the foil is maintained in a substantial horizontal plane.

Omitting for the moment the details of the construction of the clamps 23, 24, suffice it to say that the clamps are spaced apart and disposed in a common horizontal plane and are slidably mounted on a frame so that the distance between the clamps may conveniently be varied. Each of the clamps is connected to a power source adapted to impress a voltage between the clamps preferably in the range of, approximately, 0.25 to 2 volts/foot between the clamps. In the case of aluminum foil having a thickness of approximately 0.001 inches, the voltage applied to the clamps is preferably, approximately, 2 volts/foot. A convenient and preferred arrangement for obtaining such an applied voltage is to employ a step-down transformer. A particularly convenient transformer arrangement includes a single turn secondary wherein the clamps and thus the aluminum foil form part of the transformer secondary.

With an arrangement of the type described above, when a voltage of, approximately, 2 volts/foot is applied to the clamps, within a few seconds after power is applied the temperature of a thin sheet of conductive material which is not in contact with the article to be cooked (e.g. a hamburger) will be in the range of, approximately, 200° F. to 1,200° F. With an aluminum foil sheet and a voltage of approximately 2 volts/foot, the temperature of the foil not in contact with the hamburger will be approximately 600° F. However, the temperature of the foil in contact with the article to be cooked will be significantly lower than the temperature of the foil not in contact with the article to be cooked. Further, with the transfer of heat from the foil to the article, the temperature of the article and the temperature of the foil will rise but a significant temperature difference will persist between the temperature of the foil in contact with the article and the temperature of the foil not in contact with the article. As a result, cooking occurs at a relatively low temperature, i.e. the temperatures of the foil in contact with the article to be cooked will typically be less than half the temperature of the foil not in contact with the article.

Thus, it appears that through the use of a thin sheet of conductive material, e.g. aluminum foil, a heat sink effect is realized wherein heat is transferred to the article in contact with the foil at approximately the same rate that heat is generated within the foil. Therefore, virtually all the heat generated by the current flow in the foil which is in contact with the article will be transferred to the article. Thus, the only heat which is generated and which is not used to cook the article is the heat which is generated in the foil that is not in contact with the article and this may be minimized by sizing the foil substantially to correspond to the size of the food.

As a result, a number of economies and benefits may be realized. For example, the size of the aluminum foil or other sheet material may easily be pre-cut substantially to correspond to the size of the article to be cooked and since, for a given appplied voltage, the size of the sheet will determine the heat generation rate, it will be seen that this embodiment of my process automatically provides a heat generation rate which is appropriate for the size of the article to be cooked.

Another advantage of my process is that it can be practiced using an inexpensive and commonly available material, e.g. aluminum foil. Moreover, because of the low cost of aluminum foil and ease with which it can be adapted to form a cooking surface for use in my process, it will be apparent that after one use the foil may be discarded, thereby eliminating all cleaning problems. Similarly, since almost all of the generated heat is transferred to the article, only a small amount of heat is transferred to the surrounding air. Thus, the practice of my process does not result in appreciably increasing the temperature of the surrounding area.

Another surprising aspect of my process is the fact that the cooking of food can be accomplished without the physical disturbances commonly associated with frying or broiling, e.g. fat spattering. It is thought that this effect arises from the fact that there appears to be a relatively small temperature difference between the cooking surface and the food.

In the event that a fatty food article is to be cooked using my process, it is especially easy to drain any fat which is released from the food. Thus, small apertures may readily be made in the sheet material and another piece of sheet material placed below the cooking sheet. In this manner, as liquid fat is discharged from the food, it will be at a low temperature (the temperature of the food) and will readily drain through the apertures and collect on the foil below which may be disposed of, together with the cooking sheet after the food is cooked.

Unlike conventional cooking processes, in my process the fat cools to room temperature after it drains from the food. Therefore, there is little possibility of a fat fire and smoking of the fat does not occur.

Upon the occasion of my discovery, tests were conducted to ascertain quantitatively the efficiency of different embodiments of my process. For these tests, hamburgers were used as a test specimen, all of said hamburgers having a thickness of approximately 0.75 inches, a diameter of approximately 3.75 inches and each weighed approximately 0.25 lbs. To test the embodiment of my process hereinbefore described, a sheet of aluminum foil having a thickness of, approximately, 0.001 inches and a width of 4 inches was mounted as shown in FIG. 1 such that the distance between the clamps, at the lines of contact 18, 19 between the clamps and the foil, was approximately 6 inches. A hamburger test specimen of the type previously described was placed on the foil after the clamps were connected to the secondary of a step-down transformer such that the clamps and the foil formed part of the single turn secondary winding of the transformer. The primary of the transformer was connected to a conventional A.C. power outlet (nominally 115 volts, 60 cycle A.C.). At one minute intervals the following parameters were measured: the total power input to the transformer; the secondary voltage and current; the temperature in approximately the center of the test hamburger; and the temperature of a part of the foil not in contact with the hamburger. The following table sets forth the values of the measured parameters.

Table I

| Time (min.) | Total Power (Watts) | Sec. Current (Amps) | Sec. Voltage (Volts) | Hamb gr Temp. (°F.) | Foil Temp. (°F.) |
|---|---|---|---|---|---|
| 0 | 275 | 300 | 0.92 | 60 | 90 |
| 1 | 250 | 160 | 0.91 | 61 | 620 |
| 2 | " | " | " | 62 | 600 |
| 3 | " | " | " | 65 | " |
| 4 | 240 | 150 | 0.92 | 72 | " |
| 5 | " | " | " | 77 | " |
| 6 | 230 | " | " | 85 | " |
| Hamburger turned over | | | | | |
| 7 | 250 | 150 | 0.91 | 175 | 500 |
| 8 | " | " | " | 170 | " |
| 9 | " | " | " | 122 | 550 |
| 10 | " | " | " | 125 | 600 |
| 11 | " | " | 0.92 | 130 | 660 |

After the test, the specimen hamburger was inspected and both surfaces were light brown.

Considering Table I above, it will be seen that the test hamburger was fully cooked with a total energy of approximately 46 watt-hrs. or a specific energy of approximately 184 watt-hrs./lb. and at a current of 160 amperes, the heat generated in the foil was approximately 6.1 watts/sq. in.

By way of comparison, a test hamburger of the type described above was cooked in an electrically heated broiler oven of the type commonly used to cook food articles such as hamburgers. More specifically, the broiler had inner dimensions of 16"×12"×12" and heat was supplied by a Calrod unit mounted in the upper portion of the broiler, the heating unit having a rating of 1,500 watts and a 100% duty cycle, i.e. full power at all times. The test hamburger was placed on a corrugated aluminum tray which was positioned within the broiler such that the upper surface of the test hamburger was approximately three inches from the Calrod heater. During the test the temperature of the interior of the hamburger was monitored at one minute intervals. Table II presents the results of this test.

Table II

| Time (Min.) | 0 | 1 | 2 | 3 | 4 | 5 | 6 | 7 | 8 |
|---|---|---|---|---|---|---|---|---|---|
| Temp. (°F.) | 70 | 70 | 72 | 80 | 90 | 100 | 115 | 127 | 135 |

At the end of the test, the broiler was inspected and is was found that most of the exterior surfaces of the broiler were too hot to touch and the interior thereof was sufficiently spattered with fat as to require cleaning.

Considering the data presented in Table II and recognizing that the power input to the broiler was constant at 1,500 watts, it will be noted that 200 watt-hrs. were required to cook the test sample to a temperature of 135° F. and the specific energy was 800 watt-hrs./lb.

In another test of this embodiment of my discovery, the cooking surface was a perforated steel sheet having dimensions of 12" by 16" by 0.03". The sheet had 0.25 inch holes which were spaced one inch, center to center. The 12 inch sides of the sheet were clamped, the clamps being spaced apart approximately 10 inches. A steak weighing 2.13 pounds, about one inch thick and at a temperature of 45° F., was placed on the stainless steel sheet. Power was applied to the clamps and as the steak cooked the following data was recorded: the temperature at approximately the center of the steak; the temperature of the sheet at a point where the sheet was not in contact with the steak; the total power supplied to the system; and the voltage across the clamps. Table III presents this data.

Table III

| Time (Min.) | $T_{SK.}$ (°F.) | $T_{Sheet}$ (°F.) | Power (Watts) | Sec. Voltage (Volts) |
|---|---|---|---|---|
| 0 | 45 | 45 | 920 | .92 |
| 1 | 45 | 290 | 900 | .95 |
| 5 | 60 | 420 | 860 | .94 |
| 8 | 85 | 420 | 850 | .95 |
| Steak - Turned over | | | | |
| 8 | 140 | 250 | | |
| 10 | 125 | 400 | 850 | .94 |
| 13 | 135 | 450 | 850 | .94 |
| 16 | 152 | 440 | 850 | .93 |

After eight minutes, the steak was removed from the sheet and examined. The surfaces were brown, it was cooked completely through and appeared to be well done.

As may be noted from Table III above, the average power consumption was approximately 860 watts and the energy used was approximately 229 watt-hours. The specific energy expended was approximately 100 watt-hrs./lb.

Figure 2:
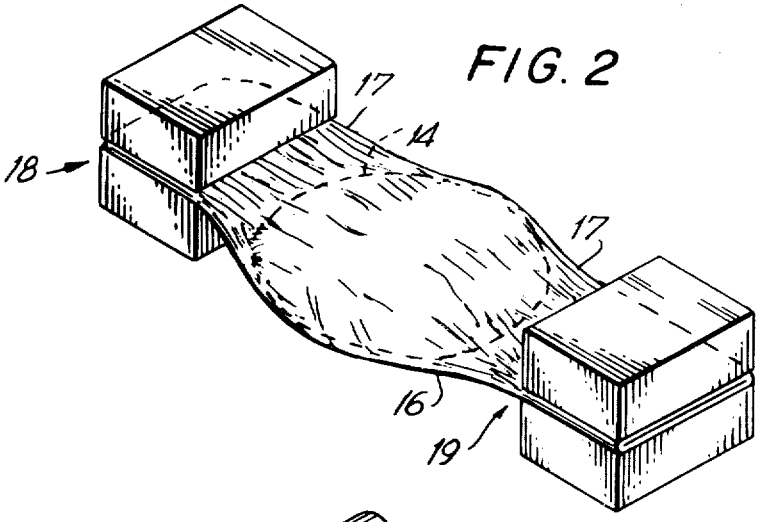
FIGS. 2-5 are perspective view of different embodiments of my invention.

Another embodiment of my process which was tested to determine its efficiency is shown in FIG. 2. In this embodiment a food article or the like, such as a hamburger, is entirely wrapped with a single layer of thin, conductive sheet material preferably having a thickness in the range of 0.0005 to 0.005 inches, e.g. a metal foil and preferably household aluminum foil. The food article is wrapped so as to maximize the physical contact between the sheet and the food article and so as to provide flat extensions of the sheet on opposite sides of the article. Thus, as shown in FIG. 2, a food article such as a hamburger 14 is wrapped in a foil 16 so as to provide extensions 17. The foil extensions are appropriately clamped as shown at 18, 19 in FIG. 2. Thereupon, the clamps are connected to a power source (not shown) providing a voltage preferably in the range of 0.25 to 2 volts/foot of spacing between the clamps.

As a result of the current flow through the sheet or foil, the temperature of the foil not in contact with the food will rise within seconds to a temperature in the range of 200° F. to 1,200° F. However, as was the case with the embodiment of my invention previously described, the temperature of the foil in contact with the food article initially is substantantially equal to the temperature of the surface of the food. Thus, once again, the food article appears to approach almost an ideal heat sink and almost all of the heat generated in the sheet or foil which is in contact with the food article will be transferred to the article and therefore cooking proceeds at a low temperature. In this embodiment of my process, heat transfer occurs over almost the entire surface area of the article with a resulting increased efficiency and decreased time required to cook the article.

In order to ascertain a measure of the efficiency of this embodiment of my process, a test hamburger specimen of the type previously described was wrapped in a sheet of household aluminum foil having a thickness of approximately 0.001 inches. The opposite ends of the foil were flattened as shown in FIG. 2 and the single layer of foil was pressed against the hamburger using only hand pressure. The two extensions were then clamped, the clamps being spaced approximately 6 inches apart. The clamps were then connected to the secondary of a transformer of the type previously described and the same parameters were monitored, the recorded values appearing in Table IV.

Table IV

| Time (Min.) | Total Power (Watts) | Sec. Current (Amps.) | Sec. Voltage (Volts) | Temp. (°F.) |
|---|---|---|---|---|
| 0 | 600 | 750 | 0.85 | 73 |
| 1 | 550 | 550 | 0.86 | 78 |
| 2 | 560 | 600 | 0.85 | 95 |
| 3 | " | " | " | 105 |
| 4 | 550 | " | " | 120 |
| 5 | " | " | 0.86 | 140 |

A study of the data set forth in Table IV indicates that the test hamburger specimen was cooked with a total energy of 46 watt-hrs. and a specific energy of 180 watt-hrs./lb. and at a current of 600 amperes and a voltage of 0.86, heat was generated in the foil at a rate of approximately 9.6 watts/sq. in. (foil area = 54 sq. in.).

Table V below is a comparison of certain data generated from the three hamburger tests previously described.

Table V

| | Cooking Time (Min.) | Total Energy (Watt-hrs.) | Specific Energy (Watt-hrs./lb.) |
|---|---|---|---|
| Flat Sheet Embodiment | 11 min. | 46 | 180 |
| Fully Wrapped Embodiment | 6 min. | 46 | 180 |
| Conventional Electric Broiler | 8 min. | 200 | 800 |

Of course, it is to be understood that my process, unlike many prior art processes, is not limited to the heating or cooking of a particular food article such as hamburgers. Thus, almost any food article or the like can be quickly and efficiently heated through the use of my process. In order to demonstrate the wide utility of my process, a number of tests were conducted wherein various food articles were cooked and the results thereof compared with prior art cooking processes. As one example, a three pound chicken at a temperature of approximately 58° F. was wrapped with a 18"×20" aluminum foil sheet having a thickness of approximately 0.001 inches, i.e. household aluminum foil. The chicken was wrapped so as to provide flattened extensions of the aluminum foil at opposite ends of the chicken. A number of small drainage holes were punched through the foil and the foil was pressed, by hand, against the surfaces of the chicken. The extensions of the foil were then clamped to terminals which were spaced 10 inches apart and connected to a step-down transformer. The transformer was powered from a conventional 115 volt, 60 cycle, A.C. power outlet and the transformer winding ratio was such as to provide a voltage of 0.82 volts across the terminals to which the foil extensions were connected. When the power was turned on the current flow in the foil averaged 620 amperes. As cooking progressed, the temperature of the foil not in contact with the chicken was 550° F. A substantial quantity of fat flowed through the drainage holes. After 35 minutes the power was turned off and the chicken was found to be fully cooked. During the test, the power input to the transformer averaged 650 watts. The following table sets forth the data measured during this test.

Table VI

| Time (Min.) | Total Power (Watts) | Sec. Current (Amps) | Sec. Voltage (Volts) | $T^*_c$ (°F.) | $T^*_f$ (°F.) |
|---|---|---|---|---|---|
| 0 | 750 | 700 | 0.82 | 58 | |
| 1 | 700 | 650 | " | 61 | |
| 5 | 680 | 640 | 0.83 | 70 | |
| 10 | 660 | 620 | " | 100 | 540 |
| 15 | 650 | 620 | " | 150 | 560 |
| 20 | " | 610 | 0.84 | 172 | 550 |
| 25 | " | 600 | " | 182 | 520 |
| 30 | 630 | 600 | " | 192 | 500 |

*$T_c$ – Temperature of chicken leg.
*$T_f$ = Temperature of foil not in contact with chicken.

Thus, the total energy expended was 325 watt-hrs. and the specific energy expended was 110 watt-hrs./lb. After the test started, the maximum heat generation rate was approximately 3.9 watts/sq. in. The following table compares the specific energy consumption of this embodiment of my process with the specific energy consumption resulting from the practice of prior art cooking processes.

Table VII (Test Specimen - 3 lb. Chicken)

| | Specific Energy (Watt-hr./lb.) | Cooking Time Min./lb. |
|---|---|---|
| Foil Wrapped | 110 | 10 |
| Microwave Oven* | 200 | 7–9 |
| Counter Top Oven* (Calrod Type) | 290 | 20–35 |
| Kitchen Range* Oven (Roasting) | Approx. 350 | 25–35 |

*Derived from available literature.

With certain bulky or dense foods, e.g. foods such as large turkeys or roasts, relatively long cooking times may be required. To substantially reduce such cooking times and realize even greater efficiencies, another embodiment of my process may be employed. In this embodiment the food article is simultaneously cooked from the outside and from the inside.

Figure 4:
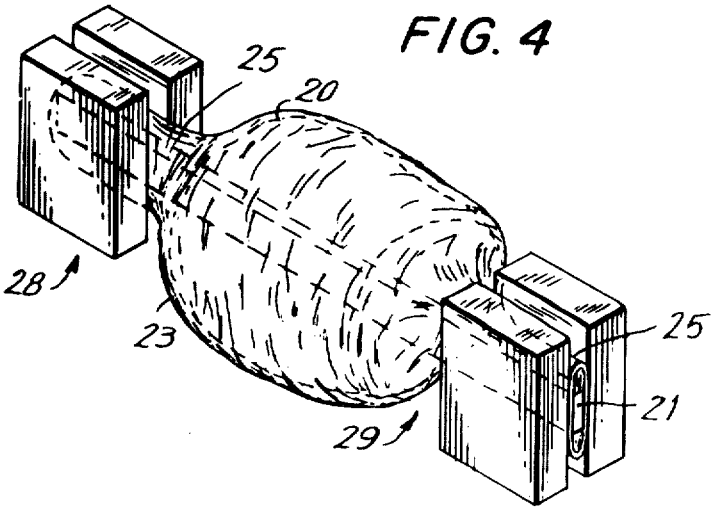

More specifically, according to this embodiment of my process and as shown in FIG. 4, a large food article 20, such as a roast, is mounted on a metal spit 21. The spit 21 is passed through the approximate center of the roast and the roast is then fully wrapped in a thin sheet of conductive material 23, such as a metal foil and preferably household aluminum foil. The foil or sheet is wrapped so as to maximize the contact between the foil and the article and to provide extensions 25 of the foil, at opposite ends of the roast, which are pressed to the spit. As shown in FIG. 4 at 28 and 29, the opposite ends of the spit are then clamped adjacent to the ends of the food article and such that the clamps also engage the extensions of the foil. The clamps are then connected to an electrical power source and a voltage preferably in the range of 0.25 to 2.0 volts/ft. is applied across the clamps.

To determine the efficiency of this embodiment of my process and to obtain a comparison thereof to other prior art cooking processes, the following test was conducted. A roast beef (round roast) was obtained which weighed 4.20 lbs., had a diameter of 4 inches and a length of approximately 12 inches. The roast, at an initial temperature of 50° F., was mounted on a 24 inch long, tinned, steel spit which had a rectangular cross section of 7/64 in.×⅜ in. The roast was then wrapped in a 18 inch by 24 inch sheet of household aluminum foil having a thickness of approximately 0.001 inches, the 24 inch dimension corresponding to the length of the roast. The foil extended beyond the ends of the roast and the extensions were folded, by hand, onto the spit. Fat drainage holes were punched in the aluminum foil and the spit was mounted in clamps which engaged and clamped the spit and the foil. The contact span between the clamps was 12.5 inches. A thermocouple was inserted through the foil and into the roast to a depth of 0.5 inches. A second thermocouple was inserted between the foil and the meat. The clamps were connected to the secondary of a single turn transformer. The transformer primary was connected to a conventional 115 volt, 60 cycle A.C. power source. Power was turned on and the following parameters were monitored: time; secondary current and voltage; total power input to the transformer; and the temperature sensed by the two thermocouples. It was not possible with the available equipment independently to measure the current in the foil and the spit. However, based on the resistance and cross sectional area of the spit and the foil, it was estimated that the current divided between the spit and the foil in the ratio 1:3. Table VIII below sets forth the results of this test.

Table VIII

| Time (Min.) | I-Sec. (Amps.) | V-Sec. (Volts) | Total Power (Watts) | T-½" (°F.) | T-Surf (°F.) |
|---|---|---|---|---|---|
| 1 | 750 | 0.75 | 650 | 65 | 125 |
| 5 | 630 | 0.75 | 580 | 90 | 200 |
| 10 | 630 | 0.75 | 540 | 133 | 238 |
| 15 | 600 | 0.76 | 500 | 155 | 250 |
| 20 | 600 | 0.76 | 480 | 165 | 250 |
| 25 | 550 | 0.76 | 450 | 175 | 260 |

When the test was stopped and the foil and spit removed, it was found that the roast was rare to medium rare and the outer surface of the roast had been browned.

Considering the data set forth in Table VIII, it will be seen that the roast was cooked using a total energy input of 210 watt-hrs. or a specific energy of only 50 watt-hrs./lb. The cooking time was 6 min./lb. and with a current of approximately 560 amperes in the foil, the heat generated in the foil was approximately 2 watts/sq. in.

Considering further the data in Table VIII, an interesting attribute of my process may be noted. Thus, it may be observed that during the test the secondary current and the total power continuously decreased. While the reasons for this power and current decrease are somewhat speculative, a meaningful manifestation of this phenomenon is the fact that, to a large extent, my process has been found to be self-regulating. Thus, it has been found that when most foods are cooked using my process, the cooking rate decreases as the food is cooked. For this reason it is particularly difficult to overcook foods using my process and the timing of the cooking of most foods is not at all as critical as most conventional cooking processes.

A particularly important aspect of my invention resides in the fact that the power supply terminals are connected to the heat generating sheet of thin, conductive material on opposite sides of the food article. Although this aspect of my discovery is surprisingly simple, the consequences thereof are profound in terms of the benefits which can be realized and the flexibility which is inherently present in the practice of my process. For example, since each heat generating sheet is connected to the power source on opposite sides of the article, a number of sheets or turns may be thus connected and the addition of each sheet will not diminish the amount of heat generated by any other sheet. Thus, in the previously described test wherein a hamburger was fully wrapped in a sheet of aluminum foil, the upper and lower sheets generated heat independently of each other. From an electrical point of view, it will be recognized that this arises from the fact that, by connecting each sheet to the power source on opposite sides of the food article, each sheet is connected in parallel and therefore the same voltage is applied across each sheet.

Further, since each sheet generates heat independently of other sheets, the heat generated adjacent to the surface of any food article may readily be multiplied by the simple expedient of using more than one sheet. For example, if a large food article such as a turkey is to be cooked, it may be mounted on a spit and then wrapped to provide two layers of aluminum foil whereby the heat generation rate is automatically approximately doubled.

To demonstrate this aspect of my discovery, a test hamburger of the type previously described was wrapped in 6.5"×18" aluminum foil sheet so as to provide two layers of foil covering the hamburger. The sheet had a thickness of approximately 0.001 inches. The sheets were hand pressed against the hamburger and were flattened to provide extensions thereof at opposite ends of the hamburger. The wrapped hamburger was then mounted in clamps such that the distance between the clamps, at the lines of contact with the foil, was approximately 6 inches. The clamps were connected to the secondary of a transformer of the type previously described. The primary of the transformer was connected to a conventional 115 volt, 60 cycle power source. During the test, the following parameters were monitored: total power to the transformer; secondary voltage and current; the temperature in approximately the center of the hamburger ($T_h$); and, the temperature of a part of the foil not in contact with the hamburger ($T_f$); Table IX indicates the results of this test.

Table IX

| Time (Min.) | Power (Watts) | Current (Amps.) | Voltage | $T_h$ (°F.) | $T_f$ |
|---|---|---|---|---|---|
| 0 | 1,000 | 1,150 | 0.70 | 60 | 90 |
| 1 | 940 | 1,000 | 0.74 | 75 | 900 |
| 2 | 900 | 1,000 | 0.75 | 125 | 1,000 |
| 3 | 900 | 1,000 | 0.75 | 135 | 1,000 |
| 3.25 | 900 | 1,000 | 0.75 | 140 | 1,000 |

As may be noted from the data in Table IX, the test hamburger was cooked in 3.25 minutes with a total energy expenditure of 49 watt-hrs., a specific energy expenditure of 196 watt-hrs./lb. and the maximum heat generation rate was approximately 7 watts/sq. in.

Another attribute or facet of my invention resides in the ability to heat packaged dinners, such as TV dinners. To demonstrate this attribute of my discovery, a frozen chicken "TV" dinner was obtained. The entire package weighed 11 oz. and the dinner was packaged in an aluminum foil tray which was 9 inches long, 7 inches wide and ⅞ inches deep. The thickness of the aluminum foil was approximately 0.0025 inches. The tray included a cover having a 0.001 inch foil lined interior surface. As suggested by FIG. 3, the ends of the tray were clamped as at 68, 69 so that the distance between the clamps was approximately 9 inches. The clamps were connected to a transformer which maintained a potential of approximately 0.7 volts, 60 cycle A.C. between the clamps. When power was applied, the data in Table X was recorded.

Table X

| Time (Min.) | Total Power (Watts) | Sec. Current (Amps.) | Sec. Voltage (Volts) |
|---|---|---|---|
| 0 | 1,100 | >1,000 | 0.71 |
| 1 | 1,050 | 1,000 | 0.73 |
| 5 | 1,040 | 940 | 0.74 |
| 10 | 1,100 | 980 | 0.75 |

After 10 minutes the power turned off, the tray removed from the clamps and the cover removed from the tray. The temperature of the food in the tray varied from 160° to 180° F. The total energy input was approximately 175 watt-hrs. or a specific energy consumption of approximately 254 watt-hrs./lb. More importantly, however, is the fact that the results of this test would not vary if two or more dinners or other food articles were connected in parallel and cooked together. Thus, in accordance with my invention, any number of food containing foil trays may be simultaneously heated.

To obtain a comparison of the efficiency of my process when used to heat food in foil trays as compared to other heating systems now used, a commercially available, electrically heated, broiler type oven was obtained, viz., a GE Model Toast-R-Oven which is specially designed to heat food articles such as TV dinners. The heating element of this oven is rated at 1500 watts and the oven generally is considered to be one of the more efficient commercially available ovens. This oven was used to heat first one TV dinner of the type described above and then two TV dinners simultaneously. To heat one dinner to the same temperature as attained in the test described above required an energy expenditure of 487 watt-hrs. and a time of 37 minutes. To heat two dinners required an energy expenditure of 610 watt-hrs., or 305 watt-hrs. per dinner and a time of 47 minutes. The following table summarizes the results of these tests.

Table XI

| | Energy Used (Watt-hrs./lb.) | Time (Min.) |
|---|---|---|
| Low Temp. Cooking 1 Dinner | 254 | 10 |
| Low Temp. Cooking 2 Dinners | 254 | 10 |
| Specialty Oven 1 Dinner | 700 | 37 |
| Specialty Oven 2 Dinners | 445 | 47 |

To obtain an overall comparison of the various embodiments of my invention and corresponding prior art cooking processes, data was collected as to electrically heated range ovens, microwave ovens and specialty counter top ovens and with respect to the variables associated with cooking in these ovens a 4 lb. roast, a TV dinner, a 4 lb. chicken or one or more hamburgers. Table XII presents this data as well as corresponding data for different embodiments of my process.

Table XII

| Food Article | Cooking Process | Connected Load (Watts) | Cooking** Time (Min./lb.) | | Energy Input (Watt-hrs./lb.) Average | |
|---|---|---|---|---|---|---|
| Roasting | | | | | | |
| 3-5 lbs. Roasts Poultry | Range Ovens | 2,400-3,700 | 25 | 35 | 350 | 430<br>270 |
| | Specialty Oven | 1,200-1,600 | 20 | 35 | 290 | 340<br>240 |
| | Microwave | 1,300-1,600 | 7 | 9 | 200 | 225<br>175 |
| | Low Temperture Process | 500-650 | 6 | 9 | 80 | 110<br>50 |
| Broiling | | | Total Min. per Batch | | | |
| 4 oz. Hamburgers | Range Ovens 1 patty | 2,700-3,000 | 12 | 18 | 2,800 | 3,240<br>2,400 |
| | 2 patties | | | | 1,400 | 1,620<br>1,200 |
| | 4 patties | | | | 700 | 810<br>600 |
| | Specialty Oven 1 patty | 1,200-1,600 | 10 | 13 | 1,055 | 1,070<br>1,040 |
| | 2 patties | | | | 522 | 535<br>520 |
| | 4 patties | | | | 261 | 262<br>260 |
| | Microwave 1 patty | 1,300-1,600 | 7 | 10 | 625 | 700<br>550 |
| | 2 patties | | | | 325 | 350<br>300 |
| | 4 patties | | | | 225 | 250<br>200 |
| | Low Temperature Process 1 patty | 250 900 | 3 | 11 | 188 | 196<br>180 |
| | 2 patties | | | | 165 | 180<br>150 |
| | 4 patties | | | | 160 | 175<br>145 |
| Frozen Foods | | | | | | |
| TV Dinners (11 oz.) | Range Ovens 1 Dinner | 2,400-2,700 | 40 | 45 | 700 | |
| | Specialty Oven 1 Dinner | 1,200-1,600 | 25 | 47 | 465 | 490<br>440 |
| | Microwave* 1 Dinner | 1,300-1,600 | 8 | 9 | 220 | 240<br>200 |
| | Low Temperature Process 1 Dinner | 550-1,050 | 10 | 15 | 225 | 254<br>200 |

*At the present time, most manufacturers of microwave ovens recommend against heating TV dinners therein.
**Including any preheating.

In Table XII a range of values is presented since cooking equipment is available with different capacities and factors such as cooking time, and therefore energy usage are dependent upon the extent to which the food is cooked, i.e. rare to well done.

Figure 5:
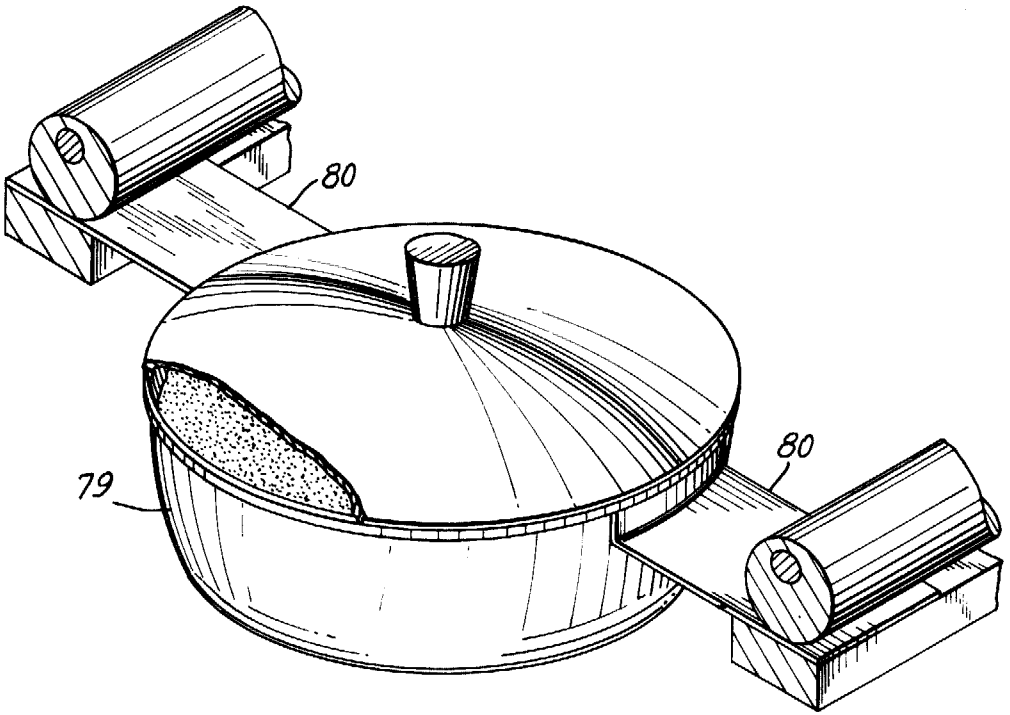

Referring to FIG. 5, there is shown a construction which demonstrates the diversity of foods which may be cooked using my invention. Specifically, there is shown a metal pot 79 having metal tabs 80 extending outwardly from opposite sides and adjacent to the top of the pot. The tabs may be spot welded to the pot.

When used, the tabs are clamped and the clamps are connected to an electric current supply means, e.g. a transformer having a single turn secondary. A food is then placed in the pot, the pot covered, and then a high electric current is passed through the pot, from one clamp to another. As shown in FIG. 5, the tabs are preferably clamped between a flat, fixed clamping surface and a curved, movable clamping surface, i.e. a rotatable shaft.

In a specific test, a pot of the type shown in FIG. 5 was employed wherein the pot was constructed of 0.017 inches thick stainless steel. The pot had a diameter of six inches at the top and the depth of the pot was 2.25 inches. The tabs were copper sheet material having a thickness of 0.32 inches and were 2 inches square. A cup of rice and 1.5 cups of water at a temperature of 65° F. were added to the pot and the pot clamped as shown in FIG. 5. A voltage of approximately 0.7 volts was impressed between the clamps and the power supplied to the transformer was approximately 250 watts. A cover was placed on the pot and then allowed to cook for 15 minutes, at which time the power was turned off. The temperature of the rice was 180° F. and, although the rice had not been stirred during cooking, it was found that none of the rice had burned and none stuck to the pot.

Figure 6:
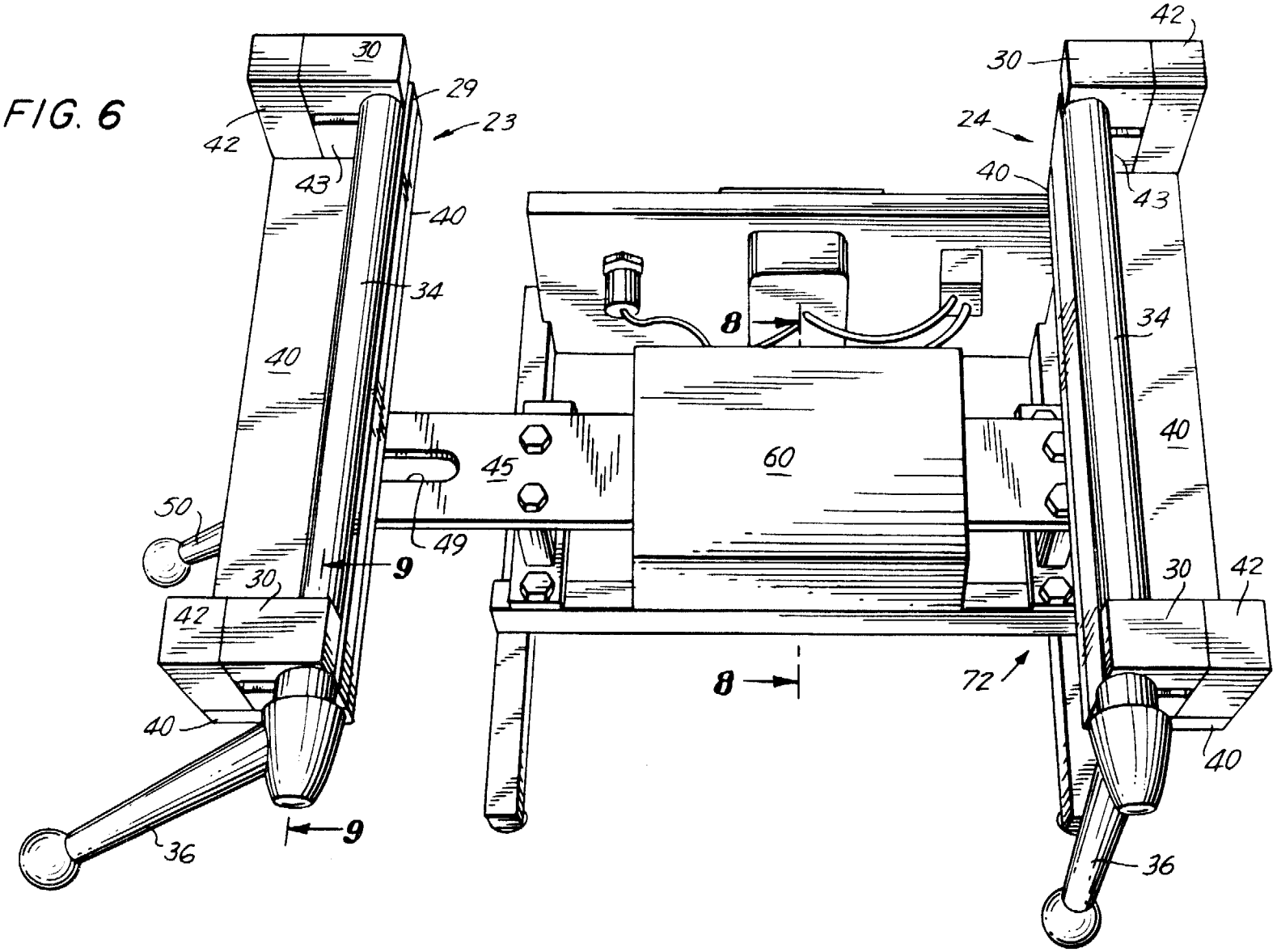
FIG. 6 is a perspective view of an apparatus for practicing certain embodiments of my process.

Considering the essential elements of my process, it will be seen that in order to facilitate the practice thereof, it is desirable to have an apparatus which permits one easily and quickly to clamp the opposite ends of a sheet of foil or other sheet of conductive material in such a manner as to permit high current transfer to the sheet without any appreciable voltage drop at the clamps. Additionally, recognizing that in the practice of my process the thin sheet of conductive material may vary substantially in both thickness, length and width, it would also be desirable to have available an apparatus which would readily accept sheets of different size. Such an apparatus is shown in FIG. 6. Referring to FIG. 6, at least one of the clamps generally referred to as 23 and 24 is preferably movably mounted so that the spacing between the clamps may be varied.

Since the clamps 23, 24 are similarly constructed, the construction of only one clamp will be described. Considering clamp 23 and referring to FIGS. 6 and 7, it will be seen that clamp 23 is comprised of a fixed or pedestal member 29 fixedly secured to plate 40. Plate 40 rests on top of and is fixedly secured to mounting block 41. At its lower end, mounting block 41 is secured to the bus bar 45 by the clamp 47. Clamp 47 is a screw type clamp having a threaded member which extends upwardly through the slot 49 in the bus bar 45 and is received in the mounting block 41. Thus, when the clamp handle 50 is rotated, the entire clamp 23 may be slidably moved along the bus bar 45. When the desired spacing between the clamps 23 and 24 is obtained, the clamp handle 50 is oppositely rotated, thereby locking the clamp 23 in position. The phantom representation 23' in FIG. 7 suggests an alternate position of the clamp 23.

Figure 7:
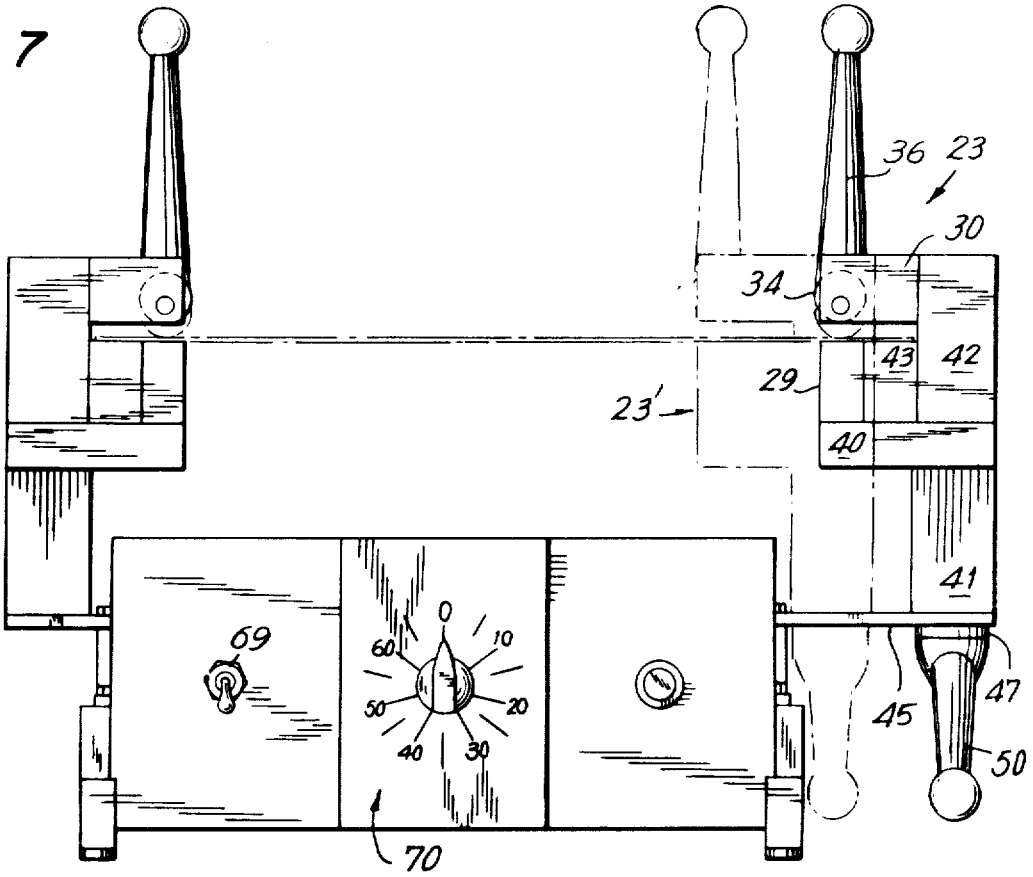
FIG. 7 is a front view of the apparatus shown in FIG. 6.

Mounting blocks 42 are fixedly mounted on top of plate 40 at opposite ends thereof, and extend upwardly. As seen in FIG. 7, a spacer 43 is provided between the mounting block 42 and the pedestal member 29.

Figures 9, 10:
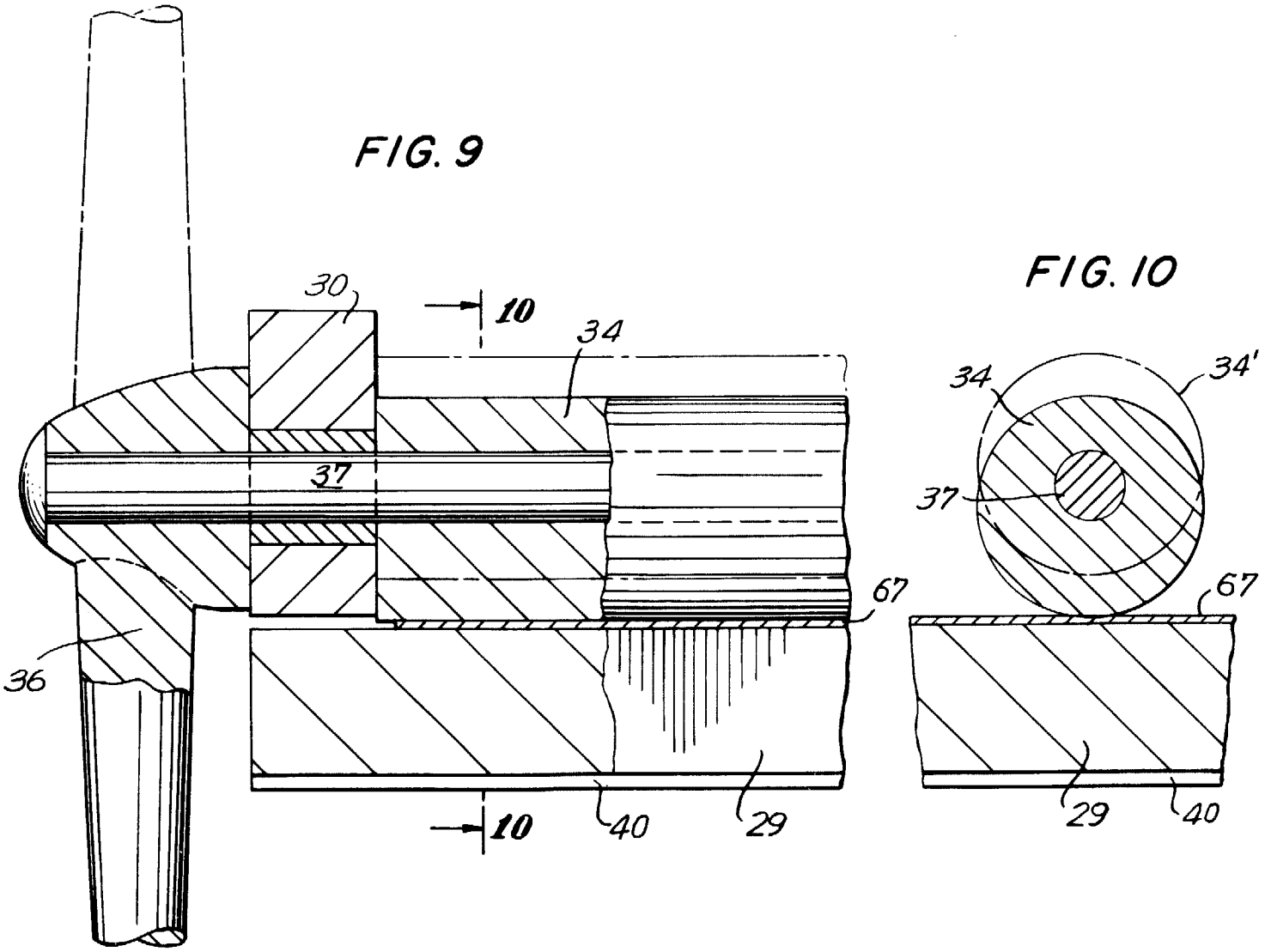
FIG. 9 is a fragmentary side view, in section, taken along the section lines 9—9 of FIG. 6.
FIG. 10 is a sectional view taken along the section lines 10—10 of FIG. 9.

Fixedly secured to and extending horizontally from each of the mounting blocks 42 is a journal block 30. As best seen in FIGS. 9 and 10, a shaft 37 extends through the journal block 30 and a cylinder member 34 is eccentrically mounted on the shaft 37, the eccentric mounting being evident in FIG. 10 and suggested by the phantom representation 34'.

Figure 8:
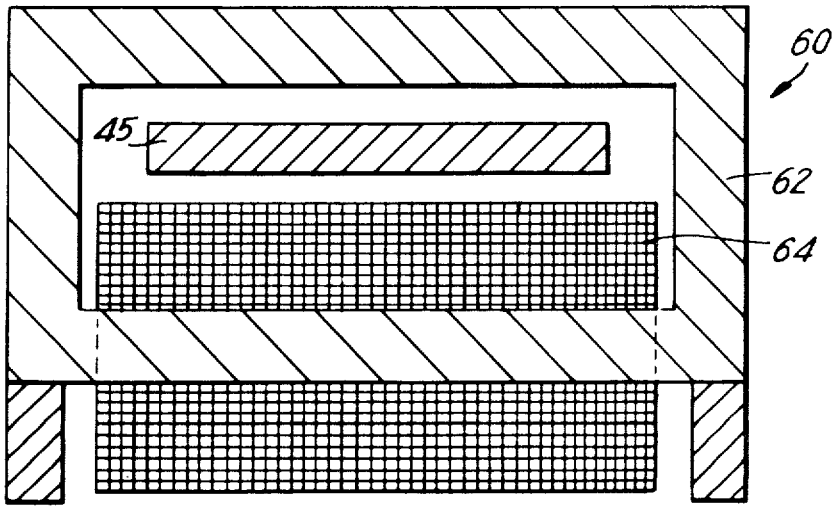
FIG. 8 is a sectional view taken along the section lines 8—8 of FIG. 6.

Considering again FIG. 6, the bus bar 45 is preferably made of solid copper, and extends horizontally through, but is not in physical contact with transformer core 62. As best seen in FIG. 8, the transformer 60 is comprised of a rectangular core 62 and primary windings 64. Of course, in operation the primary windings are connected to a suitable A.C. power source such as 115 volts, 60 cycle, although it will be evident that any suitable A.C. power source may be used, e.g. 220 volts, A.C.

When the apparatus shown in FIG. 6 is operated, the clamp 23 is positioned along bus bar 45 so as to provide the desired spacing between the clamps and then the clamp 23 is locked in position by turning the clamp handle 50. The handles 36, which provide means for moving the clamping members 34, are then rotated so as to position the cylindrical members 34 away from the pedestal members 29 as shown at 34' in FIG. 10. A sheet of conductive material 67, e.g. household aluminum foil, is then disposed between each of the pedestal members 29 and the cylindrical member 34. The handles 36 are then rotated such that the cylindrical members 34 clamp the sheet 67 as shown in FIGS. 9 and 10. An article to be cooked is placed in contact with the sheet and the transformer is connected to a suitable A.C. power source through on-off switch 69. If desired, a timer 70 may be provided. When power is applied, it will be seen that the bus bar 45, the clamps 23 and 24 and the sheet 67 form the secondary of the transformer 60. In this manner, a voltage preferably in the range of, approximately 0.25 to 2 volts per foot of spacing between the clamps may be impressed across the sheet 67.

Preferably, all the component parts of the clamps 23, 24 are made of solid aluminum. The bus bar 45 and the transformer 60 may be mounted on a frame 72 as shown in FIG. 6.

A number of features of the apparatus shown in FIGS. 6–8 are noteworthy. Thus, it will be seen that each of the clamps 23 and 24 are comprised of two clamping surfaces and one of the clamping surfaces, i.e. the cylindrical member 34, may be brought into contact with the other clamping surface by rotational movement. Thus, when a sheet is interposed between the clamping surfaces 29 and 34, the clamping surface 34 may be rotated so as to clamp the sheet and, in the process of clamping the sheet, the clamping surface 34 is brought into wiping contact with the sheet, i.e. the surface 34 wipes the sheet as the sheet is clamped. Also, it will be noted that, because the surface 34 is round, there is a tangential or line contact established between the surface 34 and a sheet which is clamped. By using a wiping action to achieve a line or tangential contact, it has been found that a tight mechanical clamp of a sheet may be achieved, with a low contact resistance between the clamping surfaces and the sheet, irrespective of the thickness of the sheet, i.e. a very low resistance contact between the clamping surfaces and the sheet may be achieved over a range of sheet thicknesses as broad as 0.0005 to 0.125 inches. Also, because of the line contact which is achieved, there is only a small area through which heat may flow to the clamps. To further insure that the clamps remain cool, the clamps may be comprised of a substantial mass, as suggested in the drawings, whereby they may function as a heat sink.

Specifically, I prefer to employ a fixed pedestal member having a thickness of at least, approximately, one half inch. Thus, with a thick pedestal member and a curved, rotatable clamping member, the apparatus in general will remain cool and the clamped sheet, in the region in which it is clamped, may be cooler than the remainder of the sheet.

In this regard, it may be noted that, as shown in FIG. 8, the rigid bus bar 45 is not in physical contact with the transformer core 62, which substantially prevents heat from being transferred to the transformer core or the transformer primary.

As shown in FIG. 1 and suggested by FIG. 7, a sheet of conductive material may be clamped within the apparatus so as to be disposed in a substantially horizontal plane whereby, after the sheet is clamped, food may be placed in contact with the sheet and cooked and then removed while the sheet is clamped. Alternatively, a food may be placed in contact with a sheet, e.g. by wrapping the food, one side of the sheet may be clamped and then the other clamp may be moved to provide the desired spacing between the clamps and then the second side of the sheet may be clamped independently of the first clamp.

Figure 3:
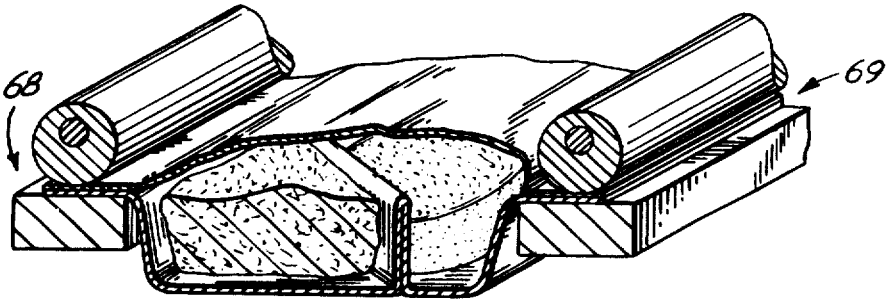

Considering further the nature of the clamping which is achieved by the apparatus shown in FIGS. 6–8, the clamping pressure is sufficiently high as to deform certain materials. Such a clamping action is particularly important when it is desired to heat an article such as a TV dinner. Specifically, a TV dinner tray is stamped and drawn from an aluminum foil sheet and generally includes a bead around the flange. Also, because of the manner in which such a tray is formed, the rim or flange of the tray and the bead are crimped. As a result, the rim of the tray does not present a smooth, flat surface against which an electrical contact may bear. Therefore, if the rim of a TV dinner is not clamped with sufficient pressure, there will be areas of only localized contact between the clamping surfaces and the tray. As a result, the contact resistance between the tray and the clamps will be substantial. Indeed, contact may exist only between the bead and the clamping surfaces. As a result, limitations are imposed with respect to the current or power which may be transferred between the tray and the clamps. Additionally, with only localized contact between the tray and the clamps, the current flow through the tray, and therefore the heating of the food in the tray, will not be uniform, i.e. some parts of the food will burn while other parts are not sufficiently heated. By contrast, when a TV dinner is clamped as shown in FIG. 3, e.g. by using the apparatus of FIG. 6, the entire length of the flange or rim of the tray is clamped and the rim of the tray, including the bead, will be flattened or deformed whereby a uniform, low resistance electrical contact is achieved. Consequently, a substantially uniform current flow exists in the tray and more uniform heating results. Thereby, substantial power can be transferred to the tray, e.g., more than approximately 900 watts, without burning the food. In this manner, a TV dinner may be quickly and uniformly heated, as indicated in the previously presented example.

Although only a prototype of the apparatus shown in FIG. 6 was constructed, the prototype device worked so well that the hamburger tests hereinbefore described were conducted on this prototype. As a measure of the efficiency of this apparatus, it may be noted that in the hamburger test previously described wherein the hamburger was wrapped with two layers of aluminum foil, 900 amperes was transferred from the clamps to the foil and only finger tip pressure was required to clamp the foil. Since eccentric clamping appears to be exceptionally efficient, it is clear that the clamps can be actuated by a variety of means such as solonoids, magnets or equivalent actuating means.

The thickness of a sheet used in my invention should be in the range of, approximately, 0.0005" and 0.125" and, for metal sheets, the applied voltage will be in the range of, approximately 0.25 to 2 volts per foot of spacing between the clamps. When the sheet material is aluminum foil, the current will generally be greater than approximately 100 amperes.

Table 15 sets forth preferred materials and thicknesses.

Table XV

| Material | Thickness (Inches) |
|---|---|
| Aluminum Foil | 0.0005 to 0.005 |
| Stainless Steel | 0.001 to 0.125 |
| Mild Steel | 0.001 to 0.020 |

Another facet of the apparatus shown in FIGS. 6 to 8 is the transformer. As shown, the transformer preferably includes a single turn secondary wherein the secondary is a rigid copper bar. Preferably, the transformer is sized to provide a secondary voltage of approximately one volt. With a secondary voltage of approximately one volt, the voltage which exists between the clamps will be in the range of approximately 0.25 to 2 volts per foot of spacing between the clamps depending upon the extent to which the spacing between the clamps can be varied. With this voltage range, I have found that a wide variety of cooking surfaces may be used without the need to resort to varying the primary voltage or varying the number of turns in the primary winding. Thus, I have found that the specific resistance of most sheet metals is such that a thickness in the range of 0.0005" to 0.125", automatically results in a total resistance which provides an appropriate cooking current at a voltage in the range of approximately 0.25 to 2 volts per foot of spacing between the clamps which clamp the sheet material. Of course, if desired, the transformer may be combined with means for varying the secondary voltage, e.g. taps in the primary or means for varying the primary voltage.

To minimize the size of the transformer, I prefer to employ a transformer core of the type shown in FIG. 8, a configuration which I refer to as an open core transformer. With such a configuration, a relatively small transformer will provide the required voltage and current with excellent regulation. For example, a transformer of the type shown in the drawings will be smaller in length and width than a TV dinner yet will supply a well regulated, high current, at a voltage of approximately one volt on a single turn secondary if the cross-sectional area of the portion of the core about which the primary is wound is approximately 4.25 square inches.

Figure 11:
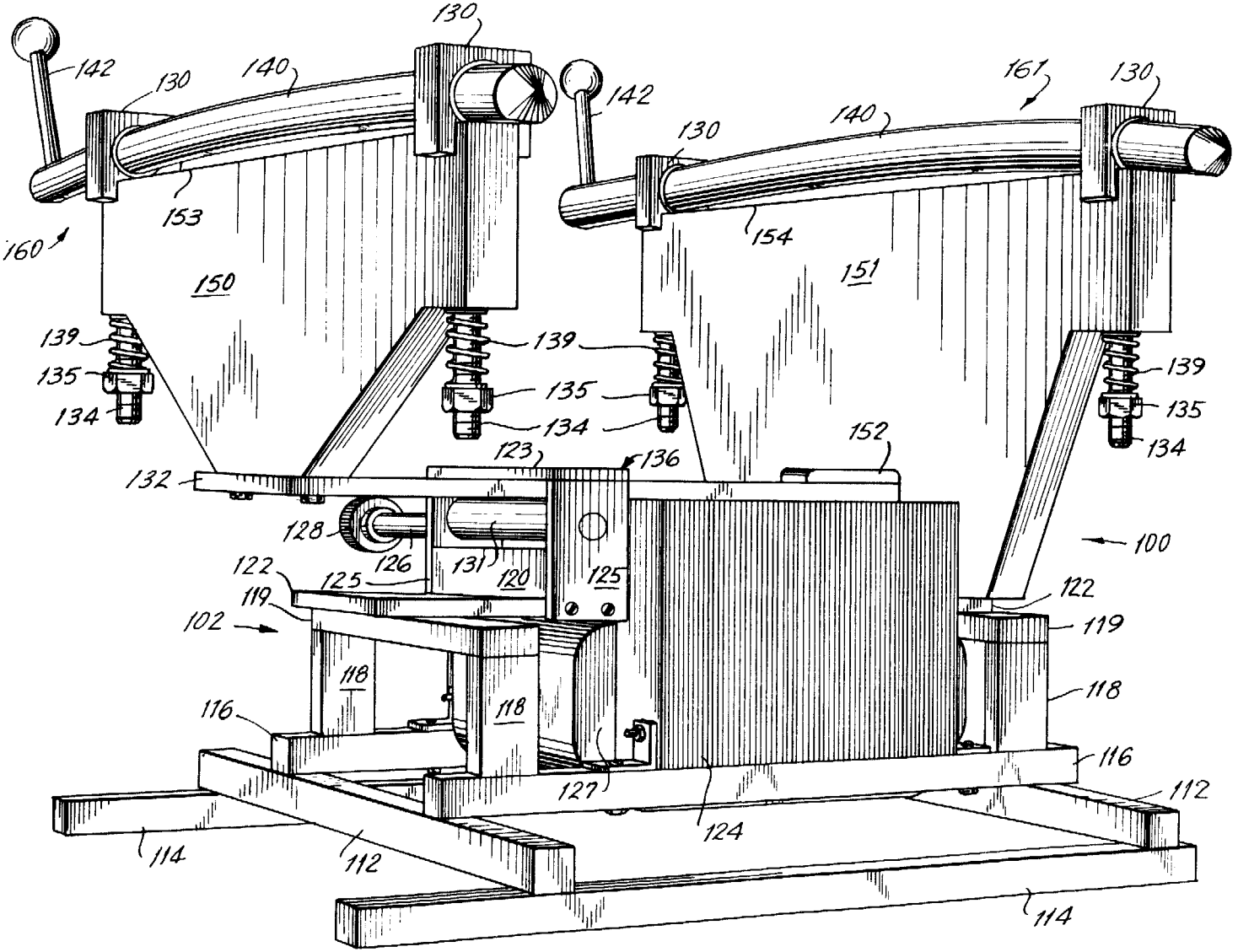
FIG. 11 is a perspective view of an improved apparatus for practicing my invention.

Referring to FIG. 11, there is shown an apparatus 100 which is a preferred apparatus for practicing my invention. More specifically, the apparatus 100 of FIG. 11 includes longitudinal support members 114 and 116 and transverse support members 112 which, together, comprise a frame 102. The support members may be secured together by any conventional means such as by welding or machine screws.

At each longitudinal end of the frame 102, a pair of spacer blocks 118 are secured to the support members 116 and extend upwardly. Secured to the top of each pair of spacer blocks 118 is an insulator block 119. A transformer core 124 of the type previously described is mounted on the frame 102, i.e. the transformer core 124 is secured to the longitudinal support members 116. A primary winding 127 is wound around the lower portion of the transformer core 124.

Extending through the transformer core, and preferably not in contact with the transformer core, is a bus bar 122 which is preferably made of copper. Preferable dimensions for the bus bar 122 are two inches wide by a quarter inch thick. The bus bar 122 forms the secondary winding for the transformer.

Secured to the bar 122 are a pair of upwardly extending plates 125. The plates 125 may be secured to the bar 122 by machine bolts 121. Preferably, the plates 123 and 125 are all made of copper or some other highly conductive metal. A plate 123 extends between and is connected to the plates 125. A shaft 126 extends through the plates 125 and is rotatably mounted therein. A knob 128 is secured to the end of the shaft 126. Eccentrically mounted on the shaft 126 is a cylindrical clamping member 131. A block 120 is mounted below the cylindrical member 131 and is secured by appropriate means to the plate 125.

Extending between the plates 125 and above the cylindrical member 131, but below the plate 123, is a second bus bar 132 which, preferably, is a copper bar having approximately the same dimensions as the bar 122.

Figure 16:
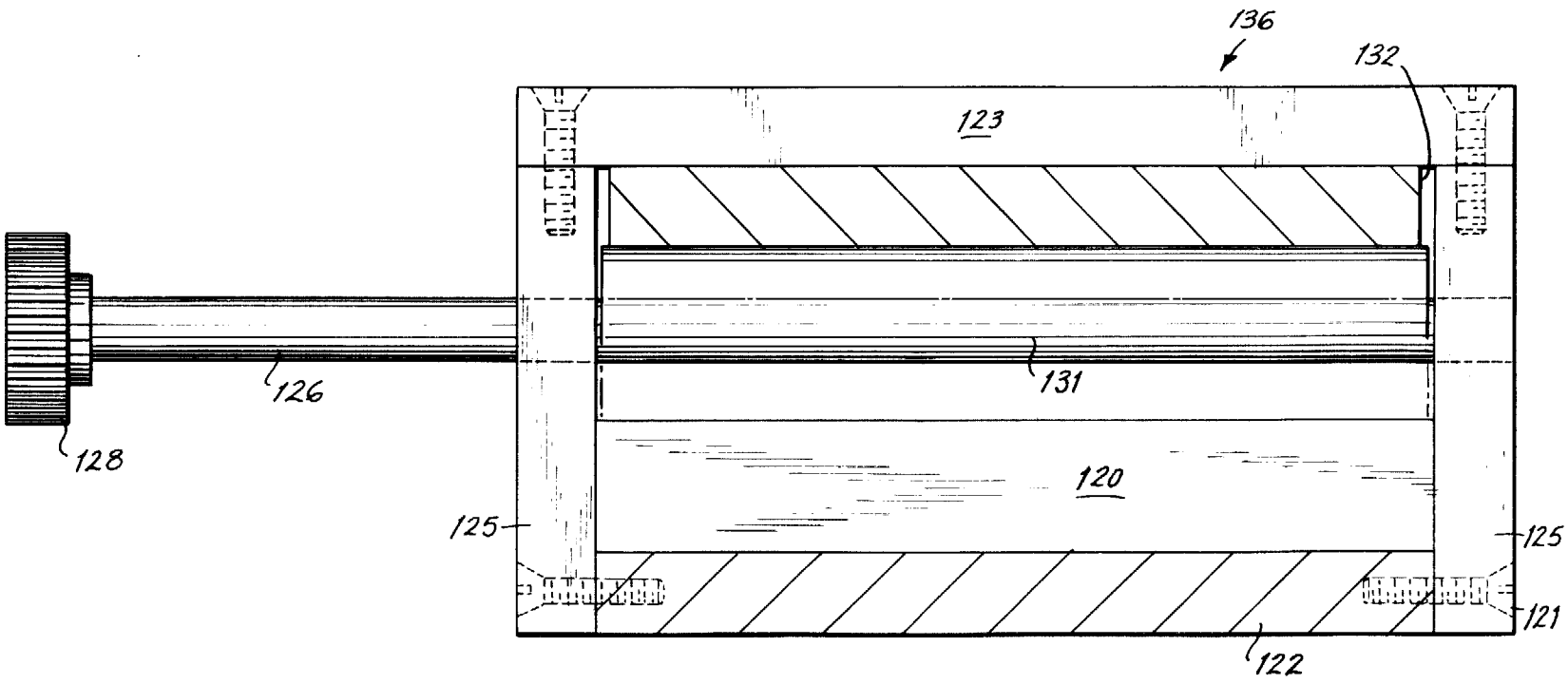
FIG. 16 is a sectional view taken along the section lines 16—16 of FIG. 11.

The construction comprised of the plates 123, 125 and the block 120 and the cylindrical member 131, together with the shaft 126, may be designated as a clamping means 136. The clamping means 136 is shown, partially in section, in FIG. 16.

Referring again to the apparatus 100 of FIG. 11, there is provided two pedestal members 150, 151, each of which is made of an electrically conductive material, for example aluminum. The pedestal member 151 is fixedly secured to and in electrical contact with the bus bar 122. Additionally, the pedestal member 151 includes an appropriately shaped aperture 152 through which the bar 132 may extend. The bar 132 is either not in physical contact with the side walls which define the aperture 152 or, alternatively, insulation is provided between the bar 132 and the side walls of the aperture 152.

The pedestal 150 is fixedly secured to and in electrical contact with the bar 132. The height of the pedestals 150, 151 is different and is adjusted such that upper surfaces 153, 154 are disposed in a common, substantially horizontal plane.

Figure 13:
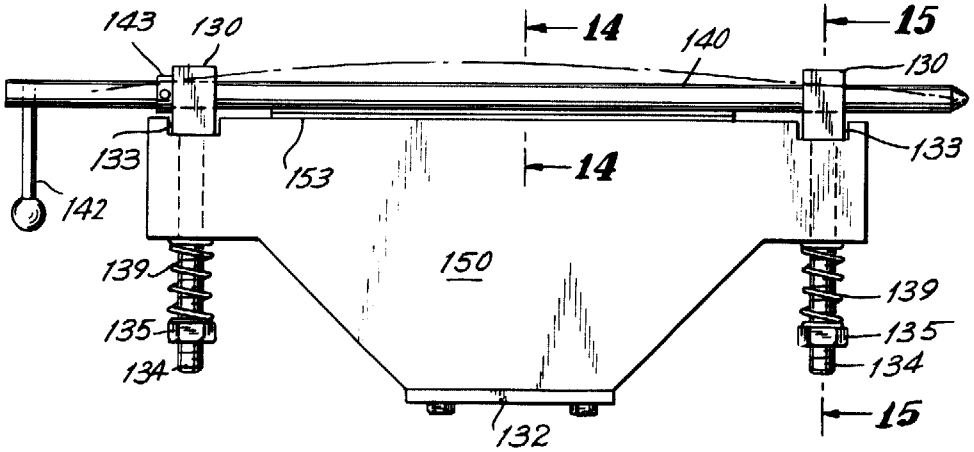
FIG. 13 is a side view of a sub-assembly of the apparatus of FIG. 11.

Each of the pedestal members 150, 151, is provided with a pair of bearings 130. As shown in FIG. 13 with respect to the pedestal 150, the bearings 130 are disposed in slots 133 which are cut in the top of the pedestal members. Additionally, in accordance with this preferred embodiment of my invention, a stem 134 is secured to each of the bearings 130 and extends downwardly through the pedestal member. The lower portion of each stem 134 is threaded. A helical spring 139 is disposed around each stem and interposed between the bottom portion of the pedestal member and a nut 135. In this manner, the precompression of each of the springs 139 may readily be adjusted by rotating the associated nut 135.

Figure 15:
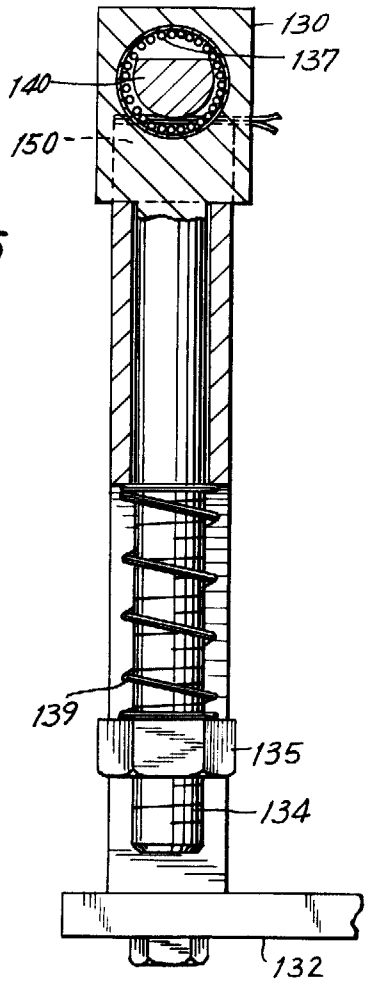
FIG. 15 is a sectional view taken along the section lines 15—15 of FIG. 11.

On each pedestal member there is provided a shaft 140 which is received in associated pairs of bearings 130. At one end of each of the shafts 140, there is provided an arm 142 to facilitate rotation of the shaft 140. A collar 143 may also be provided. Also, as shown in FIG. 15, I prefer to include friction reducing means in the form of needle bearings 137 within each of the bearings 130.

Figure 12:
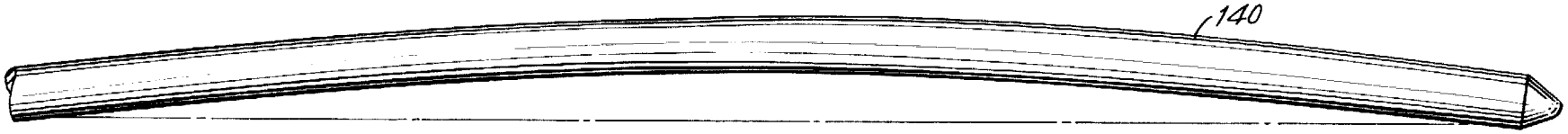
FIG. 12 is a side view of one of the components of the apparatus of FIG. 11

Each of the shafts 140 is bowed as shown most clearly in FIG. 12. Additionally, to facilitate the clamping of a sheet of material, each of the shafts 140 have been cut to remove a circular segment thereof as may be seen in FIGS. 14 and 15.

When the apparatus 100 of FIG. 11 is to be used, the spacing between the clamps 160, 161 may be adjusted. This spacing adjustment may conveniently be accomplished by rotating the knob 128 so as to position the cylindrical member 131 against the block 120 thereby freeing the bar 132. Thereupon, the clamp 160 may be moved toward or away from the clamp 161 until the desired spacing is achieved. Then, the knob 128 is rotated so as to bring the cylindrical clamping surface 131 in contact with the bar 132 whereby the bar 132 is tightly clamped between the cylinder 131 and the plate 123. It has been found that little more than finger tip rotational force is needed to tightly clamp the bar 132 by using the clamping system 136, i.e. with little more than finger tip rotational force on the knob 128, the bar 132 is tightly clamped and a particularly low resistance contact is obtained between the bar 132 and the plate 123 and the cylinder 131. In this regard, it should be noted that the cylinder 131 and the shaft 126 are also preferably made of copper whereby current may flow from the plates 125 to both surfaces of the bar 132.

After the desired spacing between the clamps 160, 161 has been achieved and the movable clamp has been locked in position, an electrically conductive sheet of material may be disposed within the clamps. To accomplish this, the clamps 140 may be rotated so that the bow of the shaft is upwardly directed or alternatively, the shafts 140 may be partially or fully withdrawn from the bearings 130 to completely expose the upper surface of the pedestal members 150, 151. The removability of the shafts 140, which form top clamping members, is particularly desirable since the flanges of a tray or the end portions of a sheet of conductive material may be placed on top of the pedestal members 150, 151. Also, the removability of the shafts 140 facilitates cleaning of both the shafts as well as the upper surfaces of the pedestal members.

After the opposite end portions of a sheet of electrically conductive material have been disposed between the respective pedestal members and the shafts 140, each of the shafts 140 is rotated approximately 180° from the position shown in FIG. 11. Preferably, this rotation is achieved by rotating each of the handles toward each other.

Figure 14:
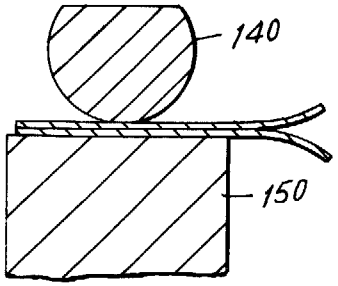
FIG. 14 is a side view, in section, taken along the section lines 14—14 of FIG. 11.

As will be seen from an inspection of the drawings, upon rotation of the shafts 140, the center portion of each of the shafts 140 will initially contact the sheet material. After such contact has been achieved, further rotation of each of the shafts 140 will cause upward forces to be imposed upon the bearings 130. Such upward forces are resisted by the springs 139. Thus, upon rotation after the initial contact, the bearings 130 will move upwardly by a relatively small amount thereby compressing the springs 139 and increasing the downward spring forces on the bearings 130. In response to these downward forces and further rotation of the shaft, the shaft 140 will straighten such that the sheet material is tightly sandwiched between the shaft and the top surface of the pedestal member. As shown in FIG. 14, a plurality of sheets may be tightly clamped.

As was the case with the apparatus of FIG. 6, because of the rotational movement of the shaft 140, a wiping contact is obtained between the shaft and a sheet of electrically conductive material, i.e. as the shaft comes into contact with the sheet, a wiping action occurs. Also, since the shaft is round or curved, a line or tangential contact is achieved between the shaft clamping member and the sheet.

When a sheet of electrically conductive material has thus been clamped, a food article may be placed on the sheet and power may be supplied to the primary 127 of the transformer whereby, current will flow through the bus bar 122, through the clamping mechanism 136, from the clamp 160 through the sheet to the clamp 161, and then through the pedestal member 151 to the bus bar 122.

The construction of the apparatus shown in FIG. 11 provides a number of functional benefits and solves a number of troublesome problems associated with the objectives of quickly and easily clamping a sheet of electrically conductive material, the thickness of which may vary over a wide range, while simultaneously providing a low contact resistance so that a current, at a low voltage, may flow through the sheet in an amount sufficient to cook a food thereon. Thus, with the apparatus of FIG. 11, one may easily clamp a sheet of electrically conductive material, having a width in the range of 4 to 10 inches and a thickness in the range of 0.001 to 0.125 inches, and transfer to the sheet a current in an amount sufficient to cook a food article placed thereon, e.g. a current greater than 50 to 100 amperes at voltage in the range of 0.25 to 2 volts per foot between the clamps.

Because of the low voltage which is used, the sheet must be clamped, across its entire width, in a substantially uniform manner, i.e. in the absence of good physical contact between clamping members and a portion of the sheet, an electrical current will flow through only a narrow width of the sheet. Thus, a food article placed on the sheet would be heated in a non-uniform manner since only a portion of the sheet would be fully heated. When a rotatable shaft is employed to effect such a clamping action, close tolerances usually must be achieved with respect to the straightness of the shaft and the uniformity of its diameter. Similarly, any associated fixed or pedestal member must have a surface which is flat and parallel with the shaft. Additionally, the members which are employed to rotatably mount the shaft must be precisely aligned so that the center line of the shaft is exactly parallel with the clamping surface of the pedestal. While it is possible, as shown by the apparatus of FIG. 6, to achieve such alignment and uniformity, it will be appreciated that a substantial expense is required in order to reliably produce such an apparatus. In addition, as may be noted with the apparatus of FIG. 6, the movable or rotatable clamping members are not removable. In contrast, a device of the type shown in FIG. 11 is far more flexible from a functional point of view and, additionally, does not require the high manufacturing tolerances which would be required with other devices. As a result, with this embodiment of my invention, irregularities in the sheet of conductive material or slight misalignments in the apparatus are automatically compensated by the deformation of the bowed shaft which occurs when the shaft is rotated into contact with the sheet material. Thus, I have surprisingly found that an apparatus embodying the construction of FIG. 11 may be constructed without the close manufacturing tolerances of a device such as that in FIG. 6, while nevertheless providing a good electrical contact with sheets of varying thicknesses and also providing removability of the movable clamping member, i.e. the shafts 140.

Still another noteworthy facet of the construction shown in FIG. 11 and 15 is the provision of the friction reducing means, for example the pin bearings 137.

To insure a deformation of the springs and a high pressure, low resistance clamping action, the top surface of the bottom-most bearing 137 should be slightly below the top surface of the associated pedestal. With this construction and an appropriate sizing of the internal diameter of the bearings, it is insured that there will be some deformation of the springs when even a very thin sheet is clamped. For example, it has been found that if the top surface of the lowermost bearings is between five to ten thousandths of an inch below the top surface of the associated pedestal, then a strain of at least a few thousandths of an inch is imposed upon the springs when a sheet of conductive material is clamped having a thickness of 0.0005 inches.

As a specific example of a construction which embodies the invention of FIG. 11 and which has been successfully tested, the shaft 140 may be made of ⅝ inch diameter 303 stainless steel wherein the removed segment is approximately ⅛ inch in height. When the bearings 130 shown in FIG. 11 are approximately 10 inches apart, it has been found that approximately 0.012 inches is a desirable amount of bow in the shaft.

In one embodiment of my invention, the bearings 130 were constructed of copper and had a height of approximately 1.125 inches and a width of approximately 0.75 inches. Each of the bearings was provided with an integral stem approximately 3.875 inches in length and threaded at the end to receive a conventional machine nut. Each of the springs was precompressed to provide a precompression force of approximately 70 pounds. To provide this force, the springs used were made of steel wire having a diameter of approximately 0.11 inches. Each of the springs was approximately one inch long and the outer diameter of the overall spring was approximately ½ inch. By screwing each of the machine nuts on to the stem, each of the springs were precompressed to provide the aforementioned precompression force of approximately 70 pounds.

In practice, it has been found that the bearings 130 should preferably be made of a material stronger than copper, e.g. mild steel, since copper bearings may permanently deform after a period of use.

Returning to the bow provided in each of the shafts 40, with a stainless steel shaft having a diameter of ⅝ inches it has been found that a deformation of approximately 5/16 inches is required to obtain a permanent deformation of approximately 0.012 inches over a 10 inch length. Moreover, if the permanent deformation is provided by supporting the shaft on supports spaced 10 inches apart and then applying a force to the center of the shaft, it has been found that the deforming force at the center of the shaft should be distributed over approximately 4 inches of the shaft. In other words, the deforming force should not be applied at a single point at the center of the shaft. Rather, a plate is preferably placed on top of the shaft and the forces applied to the plate whereby the force is distributed along a portion of the shaft.

The pedestals may advantageously be constructed from a solid aluminum block.

As hereinbefore indicated, there are a number of benefits inherent in a clamp construction which embodies my invention. One particular benefit is the ability of such a clamp to electrically clamp a foil conductor which has been crimped or which is comprised of a plurality of layers of sheet. This benefit is particularly attractive when it is desired to mount in the apparatus of FIG. 1 an article such as a TV dinner. Contributing to this benefit is the sharp edge which results when a segment of the shaft is removed, i.e. this sharp edge assists in flattening the crimped flange or bead of a TV dinner tray.

In summary, it will be seen that the following benefits attent the practice of my process:

1. The total or specific energy expended is significantly less than conventional, prior art cooking processes;

2. The cooking time is significantly less than traditional prior art food cooking processes;

3. No exotic materials or components are required and the preferred material is household aluminum foil;

4. There is only minimal cleaning after cooking;

5. The apparatus for practicing my process is simple, can be inexpensively manufactured, and is essentially comprised of a single, highly reliable active component, i.e. a transformer;

6. Conventional A.C. power sources may be used;

7. My process requires only simple operating procedures;

8. The surrounding environment is not appreciably heated;

9. During food cooking, fat is automatically removed at a low temperature thereby avoiding smoking and fire hazards;

10. The practice of my process is safe, i.e. there is no danger of electrical shock or radiation;

11. The process is not limited to a selected variety of food articles;

12. Foods may be heated or cooked in their original containers, e.g. TV dinners;

13. To a substantial degree, the process is self-regulating;

14. The efficiency of the process does not vary with the size or number of articles cooked;

15. Food heated or cooked using my process does not have to be specially prepared;

16. My process can be easily modulated;

17. DC power can be used where convenient; and

18. Because the heat source is at a relatively low temperature, temperature control equipment is not required.

Although a number of examples and embodiments of my discovery have hereinbefore been described, it is evident that the simplicity and inherent utility of my discovery provides considerable latitude with respect to such factors as operating conditions and the selection of materials. For example, as indicated in many of the examples previously described, the thin sheet of conductive material used in my process may be perforated. As such, it is to be understood that an appropriately sized conductive screen material is comprehended by the phrase "thin sheet of conductive material". Similarly, although all of the examples hereinbefore presented have used thin sheets of conductive material which were constructed of metal, it will be appreciated that other materials may be developed or employed and which possess the required thermal and electrical properties for use in my process.

Thus, those skilled in the art to which my discovery pertains may perceive embodiments of my discovery which differ substantially from the exemplary embodiments previously described but which are nevertheless within the scope of my discovery as defined by the claims appended hereto.

I claim:

1. A food cooking apparatus which comprises:

(a) a frame;

(b) an electrically conductive sheet having thickness in the range of 0.0005 to 0.125 inches;

(c) two parallel elongated electrically conductive clamps mounted on said frame for clamping respective opposite ends of said sheet to support said sheet between said clamps and make electrical contact to the ends of said sheet, each clamp comprising a first member having a horizontally disposed longitudinal upper surface and a longitudinal substantially cylindrical second member rotatably mounted above and substantially parallel to the upper surface of said first member by means of bearings adjacent each end of said second member, said second member being resiliently bowed between said bearings and being rotatable between a first position in which the substantially cylindrical side surface of said second member is bowed upward away from and does not contact the upper surface of said first member and an end of said sheet can be inserted or removed from between the upper surface of said first member and said second member, and a second position in which the end of the sheet is clamped between and in direct contact with the upper surface of said first member and the cylindrical side surface of said second member and the bow in the second member is at least partially straightened out against the clamped end of the sheet and the upper surface of the first member therebelow to apply substantially uniform pressure to the sheet along the length of the clamp; and (d) electric current supply means mounted on said frame and electrically connected to said clamps for supplying current to said clamps so that the current flows through the sheet from one clamp to the other in an amount sufficient to cook a food article disposed on said sheet between said clamps.

2. A food cooking apparatus which comprises:

(a) a frame;

(b) electric current supply means mounted on said frame; and p1 (c) a pair of electrically conductive clamps mounted on said frame for clamping respective opposite ends of an electrically conductive sheet to support said sheet between said clamps and make electrical contact to the ends of said sheet, each of said clamps comprising a fixed member having a longitudinal upper surface and a shaft rotatably mounted substantially parallel to the longitudinal surface of said fixed member by means of a bearing assembly near each end of said shaft, each bearing assembly being mounted on the fixed member associated with said shaft and comprising a bearing and means for resiliently biasing said bearing against an upper surface of said fixed member, said shaft being rotatable between a first position in which said shaft is not in contact with the longitudinal surface of said fixed member and an end of said sheet can be interposed therebetween and a second position in which the end of the sheet is clamped between and in direct contact with a side surface of said shaft and the longitudinal surface of said fixed member, said clamps being electrically connected to said current supply so that current from said current supply means may be passed through said sheet from one clamp to the other when said sheet is clamped in said clamps, thereby cooking a food article disposed in direct contact with said sheet.

3. The apparatus of claim 2 wherein each of said shafts is bowed so that the side surface of each of said shafts contacts the longitudinal surface of said fixed member only when the convex side of said shaft is rotated toward the longitudinal surface of said fixed member whereby the end of said sheet may be clamped between the convex side surface of said shaft and the longitudinal surface of said fixed member.

4. The apparatus of claim 3 wherein each of said bearing assemblies further comprises:

(a) a stem extending from said bearing through said fixed member;

(b) a spring disposed around the end portion of said stem; and (c) means mounted on the end of said stem for compressing said spring.

5. The apparatus of claim 3 wherein each of said shafts has a flat surface on the concave side thereof.

6. The apparatus of claim 2 wherein each of said shafts is removably mounted in said bearings.

* * * * *